United States Patent [19]

Blair

[11] Patent Number: 4,583,445

[45] Date of Patent: Apr. 22, 1986

[54] FLASH REDUCING MUZZLE BRAKE

[76] Inventor: Steven M. Blair, 3333 Midway Dr., Ste. 104, San Diego, Calif. 92110

[21] Appl. No.: 562,541

[22] Filed: Dec. 20, 1983

[51] Int. Cl.[4] ..... F41C 21/18

[52] U.S. Cl. ..... 89/14.2; 89/14.3

[58] Field of Search ..... 89/14.2, 14.05, 14.3, 89/14.5; 42/79

[56] References Cited

U.S. PATENT DOCUMENTS

| | | | |
|---|---|---|---|
| 1,538,243 | 5/1925 | Gorton | 89/14.2 |
| 1,636,357 | 7/1927 | Cutts, Jr. | 89/14.3 |
| 2,101,849 | 12/1937 | Green | 89/14.3 |
| 3,710,683 | 1/1973 | Kaltmann | 89/14.2 |
| 4,307,652 | 12/1981 | Witt et al. | 89/14.3 |

FOREIGN PATENT DOCUMENTS

| | | | |
|---|---|---|---|
| 911049 | 6/1946 | France | 89/14.2 |

*Primary Examiner*—Charles T. Jordan
*Assistant Examiner*—Ted L. Parr
*Attorney, Agent, or Firm*—Charmasson & Holz

[57] ABSTRACT

A muzzle brake for reducing swing, climb and recoil of a rifle is improved with a plurality of spaced ports intersecting the exit throat of the brake and venting gasses which would otherwise form an undesirable boundary layer effect. The effect of the ports is to prevent formation of the restricting boundary layer in the throat and to reduce the acceleration of gasses in the throat, thus reducing the flash effect of hot incandescent exit gasses.

4 Claims, 5 Drawing Figures

FLASH REDUCING MUZZLE BRAKE

BACKGROUND OF THE INVENTION

The modern history of firearms development includes numerous efforts to reduce the problems of recoil and climb and swing in firing of rifles and handguns. Reactive forces caused by the rapid exit of the propulsive gasses produced in the firing process typically cause the weapon to recoil against the body of the user, and when the force vector of that recoil is applied off of the shooter's center of mass, such as would be the case when the shooter's shoulder is the support point of a rifle, a moment arm between the contact point and the center of mass develops which causes the weapon typically to swing outward and upward relative to the shooter's body, necessitating reaiming and reducing accuracy. Many devices have been developed to attach to the muzzle of a firearm to redirect the exit gasses either to produce an opposite antirecoil force or to produce countering thrust vectors to compensate for swing and climb, or both an accompanying problem with such muzzle brakes which redirect gas forces has been intensification or lack of reduction of undesirable flash effects in which the hot incandescent exit gasses produced a burst of flame which can distract and partially blind the shooter as well as disclose his position in a combative situation. These problems have been recognized and discussed exhaustively in the industry, see for instance, Article entitled Vector Compensators, October, 1983 Soldier of Fortune Magazine, evaluating and comparing the instant device.

Typical examples of prior art are Cutts U.S. Pat. No. 1,636,357 Anticlimb Device disclosing an accessory muzzle device including ports for redirection of exit gasses from an antichamber forward of the rifle barrel. Kaltmann U.S. Pat. No. 3,710,683 Muzzle Brake With Flash Hider discloses a ported vector compensator with an additional conical expansion chamber to disperse incandescent gasses.

The angle of the dispersion cone relative to the bore center line is a critical factor in design of a dispersion type flash hider. While it can be readily determined usually empirically what the optimum dispersion cone design angle should be in a given application, the dispersion angle may not be so easily maintained in practice because the gas flow pattern and boundary layer buildup in the passageway will change the effective dispersion angle. This effect necessitates venting the dispersion cone through the sidewalls without destroying the integrity of the cone itself to the extent that the flash would again be exposed. Thus it is an object of the within invention to provide a muzzle brake with a dispersion-type flash hider that will include a means to maintain the optimum design exit throat shape by eliminating the restrictive effect of the boundary layer buildup in a flash hider.

SUMMARY OF THE INVENTION

The invention described within is a muzzle brake which includes an integral flash hider consisting of an exit throat dispersion cone on the forwardmost point of the muzzle brake extension to the rifle barrel, and the exit throat area is vented by angled holes drilled from the forward portion of the muzzle brake unit. The holes have the effect of breaking up the boundary layer buildup in the exit throat and eliminating restriction which would accelerate the exit gasses and derogate the flash hiding capability.

DESCRIPTION OF THE PREFERRED EMBODIMENT OF THE INVENTION

Figure 1:
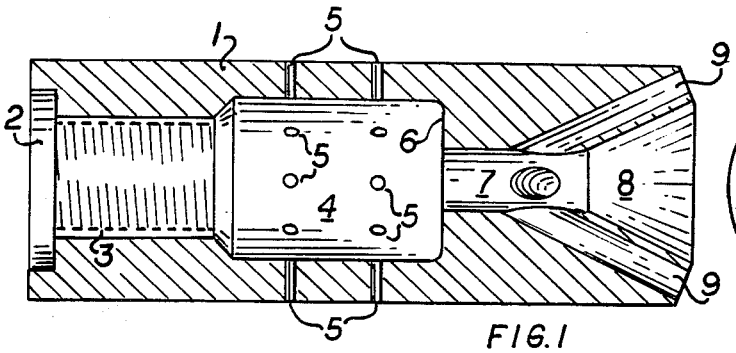
FIG. 1 is a cross-section of the cylindrical muzzle device.

With reference to FIG. 1 of the appended drawings, the invention can be seen in cross-section to consist of a cylindrical metallic body 1 having a hollow passageway of various machine surfaces along its axis. A flange matching recess 2 and threads 3 are machine formed within the cylinder to mate the device to the appropriate firearm muzzle by threads on the outer barrel of the firearm. A plenum chamber 4 is bored within the cavity, compensator ports 5 are drilled at appropriate spacings to vent the plenum chamber to the atmosphere. These spaced ports have the effect of reducing swing and climb and provide the effect of the device as a muzzle brake by the reaction force of the expanding gasses exiting those ports, delivering a force factor to counteract climb and swing.

A shoulder 6 is formed at the forward point of the plenum chamber and provides a surface for hot exit gasses of the firing process to impinge upon, and the force of those gasses striking the shoulder produces a reactive force countering recoil forces of the gasses as they had originally exited the firing chamber.

The exit throat 7 bored to provide for a close passage of the fired projectile provides the escape path for the majority of the expanding gasses which follow and propel the projectile. Because the throat is narrower than the plenum chamber, the narrowing passageway of the exit gas will result in an accelerated or venturi effect and unless in some way diminished the hot incandescent gas will result in an exiting tongue of flame or undesirable flash. Further without some dissipation the venturi effect would be intensified by the buildup of a boundary layer along the walls of the throat 7 increasing from the shoulder to the midpoint of the throat and decreasing toward the exit. The higher pressure and lower velocity along the boundary layer will further restrict the exit passageway of the high velocity gasses along axis and the further acceleration will extend the muzzle flash even farther. Two aspects of the construction shown reduce that effect. First, the exit cone 8 at the outlet of the device provides dispersion of the gasses and reduction of the flash by providing for expansion of the gasses, reduction in velocity and dissipation of the flame as it progresses out the cone. This effect as it is illustrated in the prior art however, is not effective by itself to dissipate the high velocity generated by the boundary layer effect in the throat and which to some extent will also diminish the dispersion area of the cone itself. The additional feature addresses these difficulties, providing spaced pressure bleed holes 9 extending from the face of the device to the interior of the exit passageway. The effect of the pressure bleed holes is to intersect the boundary layer at maximum pressure and bleed off that pressure decreasing the boundary layer and increasing the interior passageway diameter to its design dimensions, destroying the venturi effect caused by the boundary layer, decreasing the exit velocity of the incandescent gasses and allowing the maximum dispersion provided by the dispersion cone.

Figure 2:
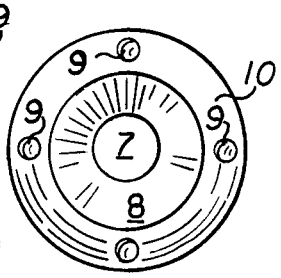
FIG. 2 is a front view of the cylindrical muzzle brake device.

FIG. 2 illustrates in a plan view of the face of the device, the spacing of pressure holes 9 around the chamfered face of dispersion cone. In this embodiment 4 such holes have empirically determined to provide adequate boundary layer bleed-off without effecting the integrity of the throat geometry.

While in this embodiment it is convenient and empirically determined to be effective to drill the pressure bleed holes at approximately a 30 degree angle and parallel to the angle of the dispersion cone, that angle may be varied according to the application. While in theory the pressure bleed hole could accomplish its function at any angle of intersection with the throat over the 180 degree range of possibility, it has been empirically determined that its most effective range is between 20 and 80 degrees relative to the axis. In fact, since even the gasses in the boundary layer do have some forward movement, the acute angle of intersection of the pressure bleed hole does facilitate movement of the hot gasses into the bleed hole and effectuate the boundary layer bleed-off.

Figure 3:
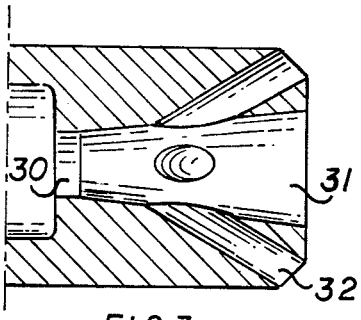
FIG. 3 is a cross-section of an alternative embodiment of the muzzle brake device with a different configuration of the exit geometry.

Another embodiment of the flash hider configuration can be seen in FIG. 3 where the exit throat 30 has been shortened and the exit cone 31 lengthened, an appropriate configuration in some applications. This view is provided to illustrate that the pressure bleed hole bore 32 in this embodiment can most effectively intersect the exit cone itself rather than the throat as the undesirable boundary layer in a shallower cone angle would extend well into the cone itself and be bled off in the interior of the cone rather than the throat.

Figure 4:
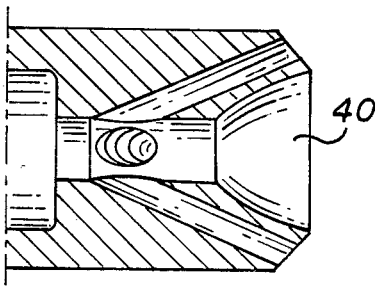
FIGS. 4 and 5 are additional cross-sectional views of alternative embodiments with different exit geometry configurations.

FIG. 4 illustrates yet another embodiment in which the shape of the exit cone is modified from a true cone to a concave parabolic shape 40 which is an advantageous shape for dispersionn of exit gasses in some applications.

Figure 5:
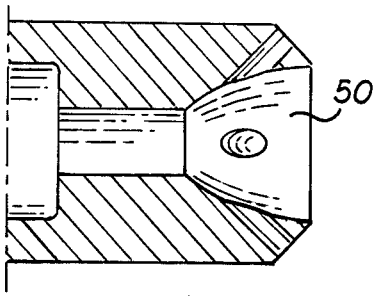

FIG. 5 illustrates yet another embodiment in which the exit cone 50 has been modified to a partial concave parabolic shape 50, and the pressure bleed hole has been bored at approximately an angle of 60 degrees to intersect the parabolic exit cone rather than the throat which in particular applications may be more effective to bleed the boundary layer at this point.

While the preferred embodiments of the invention has been described, modification could be made and other embodiments could be devised without departing from the spirit of the invention and is within the scope of the appended claims.

What is claimed is:

1. A combination muzzle brake and flash hider for installation on the muzzle of a firearm barrel comprising:

a cylindrically shaped body attachable to the muzzle in line with the axis of the barrel;

said body having an axial bore of variable radius which defines:

a mating section shaped and dimensioned for attachment to the muzzle;

following said section, an expansion chamber having an inner cross-diameter greater than the inner cross-diameter of the barrel;

following said chamber an exit throat having an inner cross-diameter commensurate with the inner cross-diameter of the barrel;

said throat expanding into a dispersion cone leading to the forward face of the cylindrically shaped body; and the wall of said cone having a plurality of passageways drilled into said forward face around the periphery of said cone in an rearwardly angular direction to intersect the cone at an angle relative to the axis of the barrel of between 20 and 80 degrees.

2. The device of claim 1 wherein the plurality of passageways number 4.

3. The device of claim 1 wherein the dispersion cone is a truncated true conical shape.

4. The device of claim 1 wherein the dispersion cone is a truncated parabolic conical shape.

* * * * *